United States Patent [19]

Soltis Charles W.

[11] Patent Number: 4,603,618

[45] Date of Patent: Aug. 5, 1986

[54] AIR FILTERING AND DISTRIBUTION FOR LAMINAR FLOW CLEAN ROOM

[76] Inventor: Soltis Charles W., P.O. Box 7328, Houston, Tex. 77248

[21] Appl. No.: 735,550

[22] Filed: May 20, 1985

[51] Int. Cl.[4] ..... F24F 7/00

[52] U.S. Cl. ..... 98/31.5; 98/34.6; 98/40.1; 52/484

[58] Field of Search ..... 98/31.5, 34.5, 34.6, 98/40.09, 40.1; 52/484

[56] References Cited

U.S. PATENT DOCUMENTS

| | | | |
|---|---|---|---|
| 2,172,771 | 9/1939 | Norris | 98/34.6 X |
| 3,220,915 | 11/1965 | Shannon | 52/484 X |
| 4,060,025 | 11/1977 | Pelosi, Jr. | 98/40.1 X |
| 4,094,232 | 6/1978 | Howorth | 98/40.1 X |
| 4,267,769 | 5/1981 | Davis et al. | 98/31.5 |
| 4,409,889 | 10/1983 | Burleson | 98/31.5 |

*Primary Examiner*—Lloyd L. King

*Attorney, Agent, or Firm*—Kane, Dalsimer, Kane, Sullivan and Kurucz

[57] ABSTRACT

An air filtering and distribution system includes a first planar section, hung from the ceiling of an enclosure, which includes air filter modules, light modules, and blank filler panels. A second planar section spaced from and hung below and generally parallel to the first planar section houses a plurality of membrane diffusion panels for uniformly distributing air through an enclosure without turbulence. The membrane diffusion panels are composed of a fibrous filter panel mounted on a grid shaped ceiling panel.

15 Claims, 3 Drawing Figures

AIR FILTERING AND DISTRIBUTION FOR LAMINAR FLOW CLEAN ROOM

BACKGROUND OF THE INVENTION

This invention pertains to a ceiling construction for a laminar flow clean room and more particularly to a membrane diffusion panel for uniformly distributing air flow through the clean room without turbulence.

The clean room industry was spawned in the early 1960's. The uniform mass air flow of HEPA (High Efficiency Particulate Absolute) filtered air was dubbed "laminar flow" because of the uniform velocity or non-turbulent (laminar) flow of air either vertically or horizontally across the work space. A typical clean room includes walls, floor, and ceiling, an air supply feeding a duct or plenum, a fan, a planar section of ceiling panels hung below the ceiling comprising HEPA filters, for filtering the air.

The advent of high tech developments in electronics, optics, telecommunications, robotics, medicine, and genetic engineering, to name a few, give rise to an ever growing need for "clean space" in manufacturing and research and development. The cleanest class of room according to federal standards is the class 100 clean room. The contamination level of clean air is generally proportional to the number of air changes per hour that is caused to move through the space. The higher the air exchange rate the cleaner the room, and the larger quantity of air filters required.

Over the last ten years inflation has given rise to the cost of Class 100 clean rooms to the point that they now install for an excess of $200.00 per square foot of work area. Thus efficient use of HEPA filters is necessary for cost efficient use of clean space. Turbulent distribution of air requires a greater number of air changes to achieve a given level of efficiency, wasting valuable filter use. Another reason that the systems are so costly is that the HEPA filters are suspended in the ceiling in an air tight framework. Along with this expensive framework must come a structural system to support the weight of the filters and a provision for the lighting system for the work space. A further disadvantage of the HEPA filtered air distribution system is that the induction of air at the ceiling causes aspiration at the filter face and turbulent air patterns develop adjacent to the HEPA filter and around that part of the ceiling that is occupied by lights and ceiling panels.

In U.S. Pat. No. 3,975,995 (Shuler) a ventilated ceiling construction is shown comprising a first planar surface spaced from the room ceiling, and having a mixed array of filter panels and blank panels, and a second planar section of perforated air diffusing panels spaced from and disposed below the first planar panel defining a clean air plenum therebetween. It has been found that a perforated sheet air diffuser is limited in its capacity to distribute air uniformly. In addition the Shuler system does not account for total elimination of turbulence. The membrane diffusion panel of the present invention is a substantial improvement over the perforated air diffusing panel of Shuler. Air is diffused evenly over the face of the membrane diffusion panel.

An additional patent of general relevance to the present invention is U.S. Pat. No. 4,461,205 (Shuler) which discloses a lighting and filtering unit for a clean room.

As can be seen from the above, in view of the expanding needs of the developing "clean space" industry an increasing need for cost effective quality air filtering exists.

SUMMARY OF THE INVENTION

The contamination level of clean space is generally proportional to the number of filtered air changes per hour that is caused to move through the space. The air exchange rate generally varies from a low of about 20 air changes per hour to a high of about 200 to 300 air changes per hour. The higher the air exchange rate the cleaner the room, and the larger the quantity of filters required in the ceiling. The present invention as shown in FIG. 2, is adapted to minimize the amount of air flow necessary to achieve desired contamination levels by providing uniform laminar flow without turbulence. In this way the number of air exchanges can be reduced for a given contamination level with consequent saving in filter costs and improved efficiency of the system.

The primary object of the present invention is to provide a structure for air filtering and distribution which takes advantage of the latest technology in materials and filter media to substantially reduce the cost and improve the performance of a vertical laminar flow clean room.

The present invention relates to the method of creating a uniform diffusion of air across the entire ceiling. By use of a translucent sheet which has controlled porosity (e.g. expanded polytetrafluoroethylene or spun bonded polyester) it is possible to fabricate a membrane panel that can be designed to lay into a conventional grid such as used to retain lay in acoustical tiles commonly used in ceilings of office buildings. The advantage of The "Membrane Diffusion" system provides that the lights for the enclosure be mounted above the ceiling thus eliminating the problem of "turbulent cones" which commonly occur when the lights are mounted below the diffused clean air ceiling. The translucent fiber sheets can be varied in pore size balancing the system to provide uniform distribution of air across the ceiling by replacing the panels in certain areas with panels of different pore size.

Applicant has discovered that, because the uniform diffusion of air across the entire ceiling of the room which is the result of the subject Membrane Diffusion Panels, the clean room can achieve much higher cleanliness levels for a given HEPA filtered air exchange rate than the conventional HEPA filtered ceiling without membrane diffusion panels. Thus the high cost of HEPA filters is reduced, making application of clean air techniques cost efficient in a wider variety of applications.

In a recent application of this technique, in a 1200 square foot clean room with 60% HEPA filtered ceiling, operating levels of better than Class 100 have been achieved. Without the Membrane Diffusion Panels an operating level of Class 5000 to 10,000 would normally be expected.

The applicant has also discovered that a slight pressure is developed in the sub-ceiling between the primary HEPA filter ceiling and the Membrane Diffusion ceiling in such a manner as to cause any leakage of air through the primary ceiling grid to be outward and away from the clean space. This has the advantage of allowing the primary grid to be installed in an inverted "T" bar grid without the use of gaskets or sealants around each grid opening surface. This advantage results in a very cost effective installation since standard commercial "T" bar grids can be used.

Applicant has further discovered that air turbulence may be minimized in the system provided by combining the aforenoted translucent membrane diffusion with lighting located in the primary ceiling, above the diffusion membrane.

The present invention provides an air filtering and distribution apparatus for use in an environmentally controlled atmosphere, which comprises a ceiling having a plurality of panels wherein at least one panel is an air filter; a translucent membrane diffusion system mounted substantially parallel to and below the ceiling, forming a plenum therebetween having controlled porosity to evenly distribute air across the face of the panel, the porosity being further controlled to resist air flow therethrough, the membrane diffusion system being comprised of a fibrous sheet mounted on a grid structure, and a means for introduing air into the plenum.

The noted objects and advantages are attained by the structure recited. These and other objects and advantages will become apparent from the following detailed description of the present invention which is to be taken in conjunction with the accompanying drawings.

DETAILED DESCRIPTION OF THE PREFERRED EMBODIMENT

Figure 1:
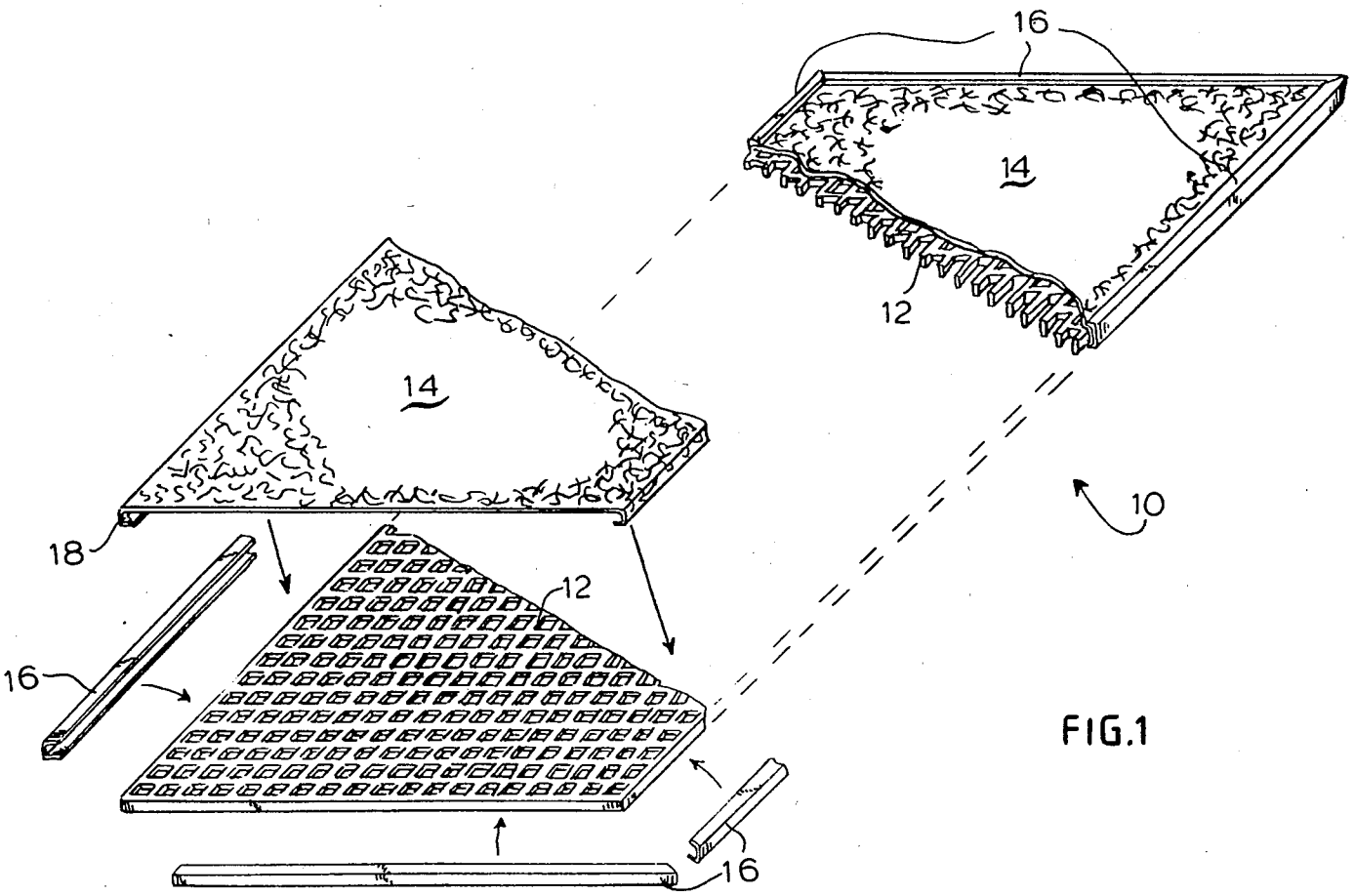
FIG. 1 is a perspective view of the membrane diffusion panel of the present invention illustrating a first side which is assembled and a second side which is disassembled, the first and second sides having a common grid plate. A portion of the grid plate is not shown and the perimeter thereof is illustrated by dotted lines.

Referring to FIG. 1, the membrane diffusion panel 10 of the present invention comprises ceiling panel 12, preferably a polystyrene ceiling panel comprising 70 to 80 percent open area. Ceiling panel 12 is preferably translucent to allow lighting fixtures affixed thereabove to provide adequate illumination for the clean air work area. As shown in FIG. 1, ceiling panel 12 may take the form of a grid having substantially parallel longitudinal and lateral bars defining apertures therebetween. A fiber sheet 14 is mounted onto ceiling panel 12. Retainer clips 16 preferably composed of an extruded plastic secure fiber sheet 14 to ceiling panel 12 to comprise the membrane diffusion panel 10.

Fiber sheet 14 includes a clip 18 along its edges to provide assurance against unfiltered air leaking past the edges of the fiber sheet. Fiber sheet 14 preferably comprises a translucent spunbound polyester structure of continuous filament polyester fibers. The "Reemay" spunbound polyester sheet by DuPont may be used. The spunbound fibers of fiber sheet 14 are bound in a manner to achieve a predetermined pore size for passage of air therethrough. Membrane diffusion panels 10 may be fabricated to lay in a conventional grid such as those commonly used to retain lay in acoustical tiles. Fiber sheets 14 of varying pore size may be used to provide balanced and uniform distribution of air across the ceiling by replacing the membrane diffusion panels 10 in certain areas with panels of different pore size. Fiber sheet 14 and ceiling panel 12, act in combination to uniformly distribute air through the work space.

Figure 2:
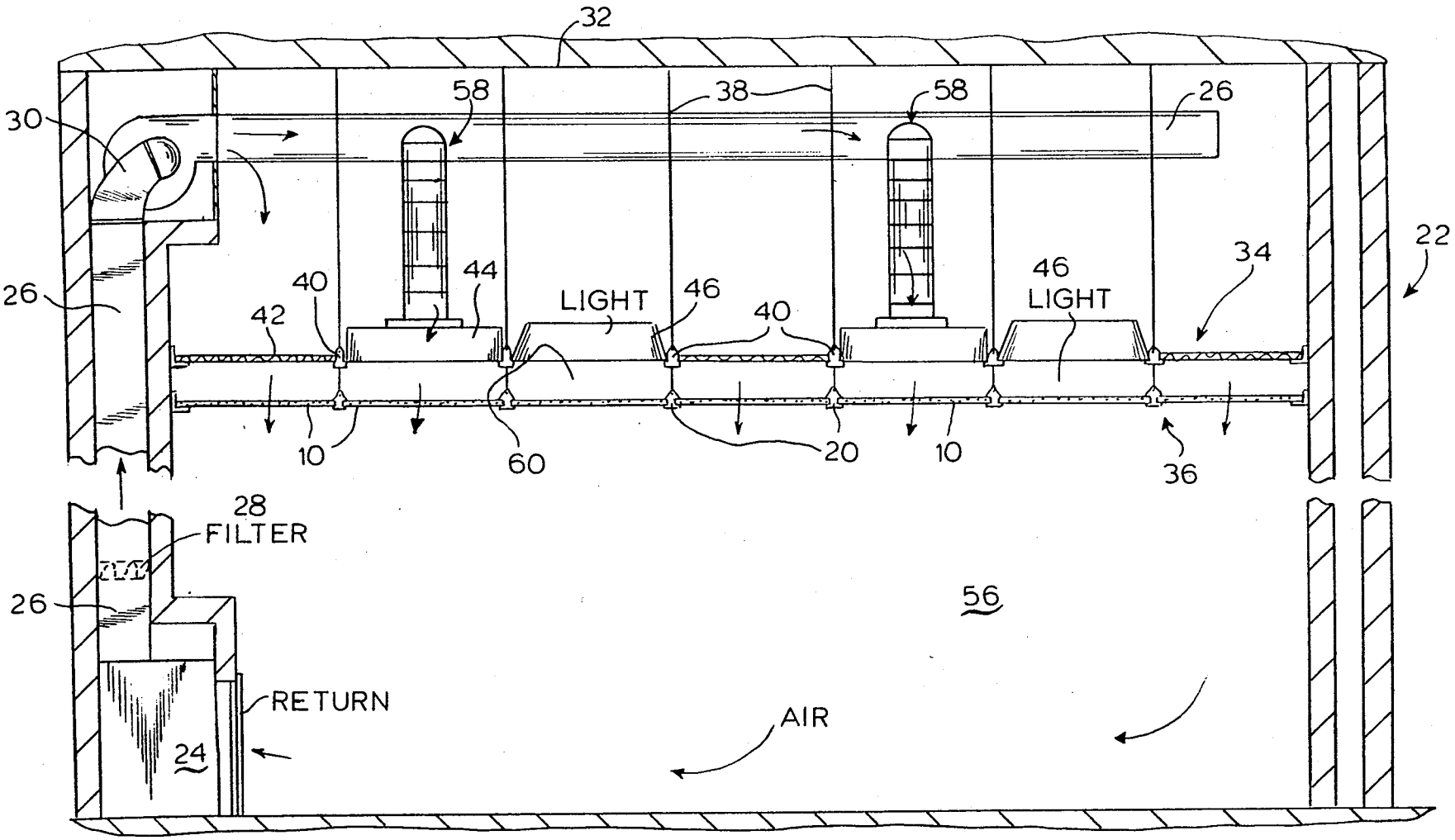
FIG. 2 is a section view of a clean room employing the structual elements of the present invention.

Referring now to FIG. 2, we see a front cut away view of a clean room 22. The clean room air circulation system generally comprises a return unit 24, ductwork 26, an optional filter 28, and fan 30. The ceiling structure comprises ceiling 32, first grid 34, and second grid 36, hangers 38 are hung from ceiling 32 to support the first and second grids.

Diffusion panels 10 are held by I-clamps which are hung from the primary grid. Air flow through the membrane diffusion panel 10 undergoes a change of pressure of 0.01 inches of water at 100 feet per minute face velocity. During operation a slight pressure is developed in the sub-ceiling between the first grid 34 and the second grid 36 causing any leakage of air through the primary ceiling grid to be outward and away from the clean space. Thus the first grid may be installed on inverted T-bar grids without the use of gaskets or sealants around each grid opening surface.

The first grid is composed of a variety of components as desired. In the embodiment of FIG. 2 the first grid comprises blank filler panels 42 composed of a conventional tile or fiberboard material, HEPA filter modules 44 comprising a conventional HEPA filter, and light modules 46 which are spaced from the translucent membrane diffusion panel 10 to avoid interference with air flow.

Figure 3:
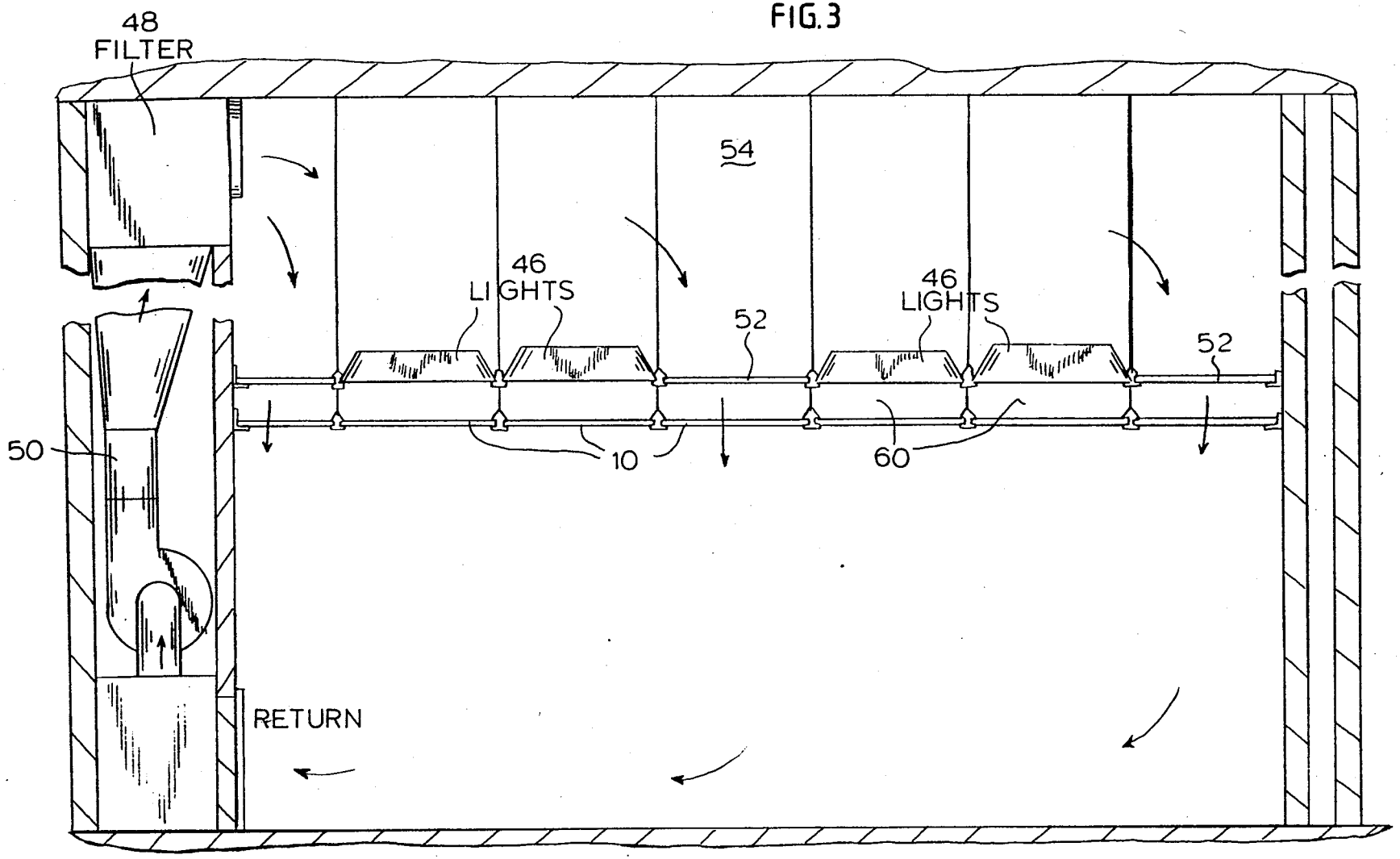
FIG. 3 is a section view of an alternate embodiment of a clean room employing the elements of the present invention.

Air flow in the embodiment of FIG. 2 follows a path from workspace 56 to return unit 24 (note the arrows in FIGS. 2 and 3 indicating direction of air flow). The dirty air then passes into duct 26, through optional filter 8 if provided, to fan 30. Fan 30 increases flow pressure, pushing the air into the supply duct. The air then diffuses through the HEPA filters 44 into space 60. Air passes through HEPA Filter modules 44 and is filtered thereby. Clean air then passes into space 60 between the first and second grids. Resistance to air flow through lower grid 36 is provided by controlling the porosity of the various membrane diffusion panels 10. In this manner the system is designed to provide uniform air flow into clean space 56.

FIG. 3 represents an alternate embodiment wherein the HEPA filter 48 is located at the outlet of duct 50. Filtered air is blown into plenum 54 and passes through panels 52 of the first grid which may be composed of any conventional panel material which provides air ventilation. In the embodiment of FIG. 3 a single filter may be used. Ease of replacement of the filter and simplicity in ceiling construction are achieved. Membrane diffusion panels 10 operate in the embodiment of FIG. 3 in the same manner as described above. A vertical flow clean room having ceiling HEPA filters generally requires a uniform flow of approximately 100 feet per minute across the ceiling supply so that the HEPA filters are loaded at the rate of approximately 100 feet per minute face velocity. This low face velocity has the advantage of enabling long filter use without change. New filter technology allows HEPA filters (and bag filters with efficiencies equal to HEPA filters) to be operated at face velocities of 500 feet per minute or higher. The fan filter of FIG. 3 takes advantage of this new technology by loading filter 48 to handle as much air as five conventional ceiling HEPA filters of the same face area. Fan filter unit 48 provides a supply of class 100 air or better into plenum 54. Plenum 54 may be constructed from conventional building materials, for example: Sheetrock, which is taped, floated and painted with an epoxy paint.

Thus it is evident that the present invention realizes improved distribution of air flow without turbulence thereby providing a cost efficient air filtration and distribution system. Although a preferred embodiment of the invention has been disclosed and described in detail herein, it should be understood that this invention is in no sense limited thereby and its scope is to be determined by that of the appended claims.

What is claimed is:

1. An air filtering and distribution structure for use in an environmentally controlled enclosure, said structure comprising:

a first planar section spaced a predetermined distance from one surface of said enclosure, means for diffusing air through the first planar section such that the air is filtered thereby; and a second planar section spaced a predetermined distance from and generally parallel to said first section, the second planar section comprising a plurality of membrane diffusion panels, each membrane diffusion panel comprising a frame having an open area, and a porous membrane sheet having a predetermined porosity mounted onto and extending over the frame and the open area therein with the porosity providing a predetermined resistance to flow of the air whereby during operation a slight pressure is developed between the first planar section and second planar section causing any leakage of air through the first section to be away from the controlled enclosure so that the membrane diffusion panels cooperate to provide uniform air flow through the second planar section such that the environmentally controlled enclosure achieves higher cleanliness levels for a given filtered air exchange rate than would be obtained without the membrane diffusion panels.

2. The air filtering and distribution structure as defined in claim 1 wherein the first section comprises a mixed array of panels having air filter panels and other panels, and wherein a clean air plenum is defined between the first planar section and the second planar section.

3. The air filtering and distribution structure as defined in claim 2 wherein the membrane diffusion panel is translucent.

4. The air filtering and distribution structure as defined in claim 3 wherein the membrane sheet comprises a structure of continuous filament fibers.

5. The air filtering and distribution structure as defined in claim 4 wherein the membrane sheet further comprises a spunbound structure of polyester fibers.

6. The air filtering and distribution structure as defined in claim 3 wherein the mixed array of panels of the first planar section further comprises at least one light module mounted therein to provide lighting for the enclosure.

7. The air filtering and distribution structure as defined in claim 4 wherein the membrane sheet is mounted on the ceiling panel and the ceiling panel comprises a plastic panel having a multiplicity of apertures extending therethrough.

8. The air filtering and distribution structure as defined in claim 7 wherein the ceiling panel has the form of a grid having substantially parallel longitudinal and lateral bars defining apertures therebetween.

9. The air filtering and distribution structure as defined in claim 8 wherein the membrane diffusion panel further comprises retainer clips to secure the fiber sheet to the ceiling panel.

10. The air filtering and distribution structure as defined in claim 1 further comprising an air filter located at an air inlet to the enclosure wherein all air entering the enclosure passes through the air filter and wherein a clean air plenum is defined between the first planar section and a surface of the enclosure.

11. The air filtering and distribution structure as defined in claim 10 further comprising:

a return unit located on a side of the enclosure at floor level into which air passes from the enclosure;

a vertical duct located on the side of the enclosure which houses the return unit in a lower portion thereof;

a fan for increasing the flow pressure of the air located in a central portion of the duct;

the air filter, located in an upper portion of the duct and adapted to filter air blown by the fan into a clean air plenum area.

12. An environmentally controlled enclosure having an air filtering and distributing structure as defined in claim 11 wherein the first planar section housing light modules and air filtering means, and the second planar section, disposed below the first planar section, houses translucent membrane diffusion panels for uniformly distributing air through the enclosure.

13. An environmentally controlled enclosure having an air filtering and distributing structure as defined in claim 10 wherein the membrane diffusion panels comprise a fibrous panel mounted on a grid shaped ceiling panel.

14. A membrane diffusion panel for distributing air in a filtered environmentally controlled enclosure, said panel comprising:

a translucent support panel having a plurality of apertures extending therethrough wherein the panel comprises at least 50 percent open area for allowing air passage therethrough;

a translucent porous membrane sheet mounted on the support panel comprises a structure of continuous filament fibers, the membrane sheet having porosity and extending over the open area with the porosity providing a predetermined resistance to flow of the air so that the membrane diffision panel cooperates to provide uniform air flow through the environmentally controlled enclosure such that the environmentally controlled enclosure achieves higher cleanliness levels for a given filtered air exchange rate than would be obtained without the membrane diffusion panel.

15. An air filtering and distribution structure of use in an environmentally controlled enclosure, said structure comprising:

a first planar section spaced a predetermined distance from one surface of said enclosure thereby defining a supply air plenum therebetween, said first section comprising a mixed array panels having air filter panels, blank panels and light modules; and a second planar section spaced a predetermined distance from and generally parallel to said first section defining a clean air plenum between the first planar section and the second planar section, the second planar section comprising a plurality of membrane diffusion panels wherein each membrane diffusion panel comprises a translucent plastic ceiling panel having the form of a grid having substantially parallel longitudinal and lateral bars defining apertures therebetween, and a fiber sheet comprising a structure of continuous filament spunbound polyester fibers having a predetermined porosity mounted onto and extending over the ceiling panels and the apertures therein with the porosity providing a predetermined resistance to flow of the air whereby during operation a slight pressure is developed between the first planar section and second planar section causing any leakage of air through the first section to be away from the controlled enclosure so that the membrane diffusion panels cooperate to provide uniform air flow through the second planar section.

* * * * *

REEXAMINATION CERTIFICATE (1081st)

United States Patent [19] [11] B1 4,603,618

Soltis [45] Certificate Issued Jun. 20, 1989

[54] AIR FILTERING AND DISTRIBUTION FOR LAMINAR FLOW CLEAN ROOM

[76] Inventor: Charles W. Soltis, P.O. Box 7328, Houston, Tex. 77248

Reexamination Request:
No. 90/001,504, May 4, 1988

Reexamination Certificate for:

| | |
|---|---|
| Patent No.: | **4,603,618** |
| Issued: | **Aug. 5, 1986** |
| Appl. No.: | **735,550** |
| Filed: | **May 20, 1985** |

[51] Int. Cl.[4] ..... F24F 7/00

[52] U.S. Cl. ..... 98/31.5; 98/34.6; 98/40.1; 52/484

[58] Field of Search ..... 98/34, 33.1, 31.5, 493; 55/DIG. 29, 502, 385.2; 362/294, 330

[56] References Cited

U.S. PATENT DOCUMENTS

| | | | |
|---|---|---|---|
| 2,172,771 | 9/1939 | Norris | 98/34.6 X |
| 3,220,915 | 11/1965 | Shannon | 52/484 X |
| 3,252,400 | 5/1966 | Madl, Jr. | 98/33.1 X |
| 3,403,614 | 10/1968 | Carnes | 362/330 X |
| 3,418,915 | 12/1968 | Marble | 55/DIG. 29 |
| 3,782,082 | 1/1974 | Smith et al. | 55/502 |
| 3,975,995 | 8/1976 | Shuler | 98/40 D |
| 4,060,025 | 11/1977 | Pelosi, Jr. | 98/40.1 X |
| 4,094,232 | 6/1978 | Howorth | 98/40.1 X |
| 4,267,769 | 5/1981 | Davis et al. | 98/31.5 |
| 4,409,889 | 10/1983 | Burleson | 98/31.5 |
| 4,554,766 | 11/1985 | Ziemer et al. | 52/28 |

*Primary Examiner*—William E. Wayner

[57] ABSTRACT

An air filtering and distribution system includes a first planar section, hung from the ceiling of an enclosure, which includes air filter modules, light modules, and blank filler panels. A second planar section spaced from and hung below and generally parallel to the first planar section houses a plurality of membrane diffusion panels for uniformly distributing air through an enclosure without turbulence. The membrane diffusion panels are composed of a fibrous filter panel mounted on a grid shaped ceiling panel.

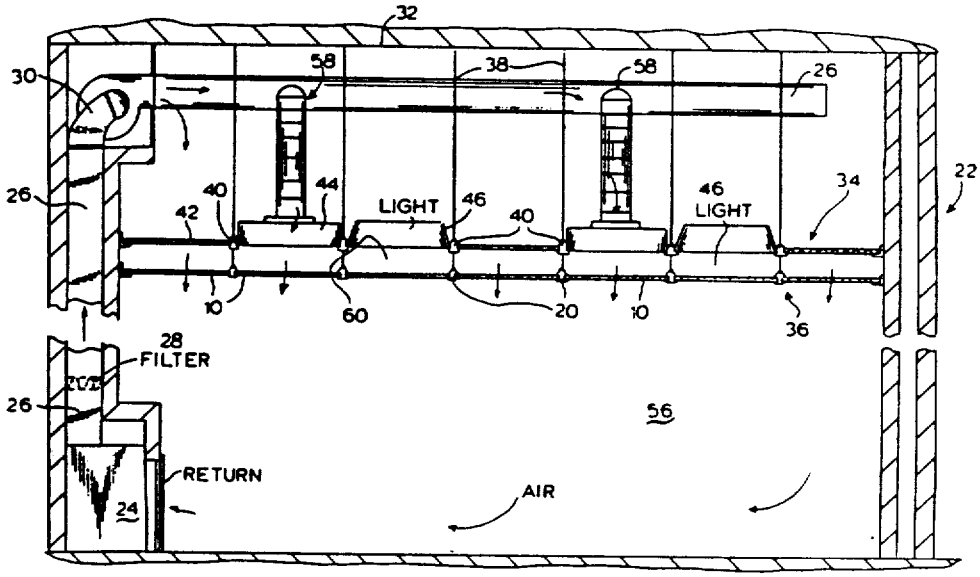

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 14 and 15 is confirmed.

Claim 3 is cancelled.

Claims 1, 4 and 6 are determined to be patentable as amended.

Claims 2, 5 and 7–13, dependent on an amended claim, are determined to be patentable.

1. An air filtering and distribution structure for use in an environmentally controlled enclosure, said structure comprising:

a first planar section spaced a predetermined distance from one surface of said enclosure *and defining a first plenum*, means for diffusing air through the first planar section such that the air is filtered thereby; and a second planar section spaced a predetermined distance from and generally parallel to said first section *and defining therewith a second plenum at a relatively higher pressure that will cause any leakage of air through the first section to be away from the controlled enclosure*, the second planar section comprising a plurality of *translucent* membrane diffusion panels, each membrane diffusion panel comprising a frame having an open area, and a porous membrane sheet having a predetermined porosity mounted onto and extending over the frame and the open area therein with the porosity providing a predetermined resistance to flow of the air whereby during operation a slight pressure is developed between the first planar section and second planar section causing any leakage of air through the first section to be away from the controlled enclosure so that the membrane diffusion panels cooperate to provide uniform air flow through the second planar section such that the environmentally controlled enclosure achieves higher cleanliness levels for a given filtered air exchange rate than would be obtained without the membrane diffusion panels.

4. [The air filtering and distribution structure as defined in claim 3 wherein the membrane sheet comprises] *An air filtering and distribution structure for use in an environmentally controlled enclosure, said structure comprising:*

*a first planar section spaced a predetermined distance from one surface of said enclosure, the first section comprising a mixed array of panels having air filter panels and other panels, means for diffusing air through the first planar section such that the air is filtered thereby; and*

*a second planar section spaced a predetermined distance from and generally parallel to said first section, a clean air plenum being defined between the first planar section and the second planar section, the second planar section comprising a plurality of translucent membrane diffusion panels, each membrane diffusion panel comprising a frame having an open area, and a porous membrane sheet having* a structure of continuous filament fibers *and a predetermined porosity mounted onto and extending over the frame and the open area therein with the porosity providing a predetermined resistance to flow of the air whereby during operation a slight pressure is developed between the first planar section and second planar section causing any leakage of air through the first section to be away from the controlled enclosure so that the membrane diffusion panels cooperate to provide uniform air flow through the second planar section such that the environmentally controlled enclosure achieves higher cleanliness levels for a given filtered air exchange rate than would be obtained without the membrane diffusion panels.*

6. The air filtering and distribution structure as defined in claim [3] *2* wherein the mixed array of panels of the first planar section further comprises at least one light module mounted therein to provide lighting for the enclosure.

* * * * *